US009719192B2

(12) United States Patent
Kübler et al.

(10) Patent No.: US 9,719,192 B2
(45) Date of Patent: Aug. 1, 2017

(54) SPINNING UNIT OF AN AIR JET SPINNING MACHINE AND THE OPERATION OF SUCH A MACHINE

(71) Applicant: Maschinenfabrik Rieter AG, Winterthur (CH)

(72) Inventors: Markus Kübler, Geislingen (DE); Gernot Schäffler, Wäschenbeuren (DE); Martin Widmann, Donzdorf (DE)

(73) Assignee: Maschinenfabrik Rieter AG, Winterthur (CH)

( * ) Notice: Subject to any disclaimer, the term of this patent is extended or adjusted under 35 U.S.C. 154(b) by 56 days.

(21) Appl. No.: 14/813,968

(22) Filed: Jul. 30, 2015

(65) Prior Publication Data

US 2016/0032498 A1 Feb. 4, 2016

(30) Foreign Application Priority Data

Jul. 30, 2014 (CH) ..... 1167/14

(51) Int. Cl.
*D01H 4/02* (2006.01)
*D01H 1/115* (2006.01)
*D01H 13/30* (2006.01)

(52) U.S. Cl.
CPC ..... *D01H 4/02* (2013.01); *D01H 1/115* (2013.01); *D01H 13/306* (2013.01); *D01H 2700/21* (2013.01)

(58) Field of Classification Search
CPC ..... D01H 4/02; D01H 13/306; D01H 1/115; D01H 2700/21

(Continued)

(56) References Cited

U.S. PATENT DOCUMENTS 1,986,974 A * 1/1935 Kellogg ..... B65H 69/02 156/158
3,286,073 A * 11/1966 Kofron ..... B23K 9/291 219/137.42

(Continued)

FOREIGN PATENT DOCUMENTS

CN 102226303 A 10/2011
DE 10256293 A1 6/2004

(Continued)

OTHER PUBLICATIONS

Swiss Patent Office Search Report, dated Oct. 7, 2014.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A method and system for operating an air jet spinning machine, that features at least one spinning unit with one spinning nozzle for producing a yarn. During normal operation of the spinning unit, a fiber composite is fed to the spinning nozzle through an inlet and in a predefined transport direction. The fiber composite within a vortex chamber of the spinning nozzle receives a twist with the assistance of a vortex air flow, such that a yarn is formed from the fiber composite, which leaves the spinning nozzle through an outlet. After an interruption in yarn production, a piecing process is carried out, with which one yarn end on the spool side moves counter to the transport direction through the spinning nozzle, is overlaid with one end of the fiber composite after passing through the spinning nozzle and, together with this, is brought through the inlet into the spinning nozzle. After conclusion of the piecing process, the production of yarn is continued through the resumption of normal operation. During the piecing process, at least temporarily, additive is applied at the end of the fiber composite.

10 Claims, 5 Drawing Sheets

(58) Field of Classification Search
USPC ..... 57/333, 296
See application file for complete search history.

(56) References Cited

U.S. PATENT DOCUMENTS 3,478,398 A 11/1969 Barlow et al.
3,634,972 A * 1/1972 Illman ..... B60C 9/0028 57/202
3,643,417 A * 2/1972 Irwin ..... B65H 69/061 57/202
3,826,073 A * 7/1974 Hoeber ..... D01H 4/02 57/263
4,114,358 A * 9/1978 Tsuchida ..... D01H 1/115 57/293
4,509,321 A * 4/1985 Kajita ..... D01H 1/115 57/328
4,545,193 A * 10/1985 Tanaka ..... D01H 15/002 57/22
4,573,313 A * 3/1986 Bertrams ..... B65H 69/066 57/22
4,620,413 A * 11/1986 Anahara ..... D01H 15/002 57/22
4,845,932 A * 7/1989 Sakai ..... D01H 1/115 57/224
4,958,487 A * 9/1990 Suganuma ..... D01H 1/11 57/328
5,146,740 A * 9/1992 Mori ..... D01H 4/02 57/328
5,175,983 A * 1/1993 Artzt ..... B65H 69/063 57/1 UN
5,193,335 A * 3/1993 Mori ..... D01H 1/115 57/296
5,211,001 A * 5/1993 Mori ..... D01H 4/02 57/328
5,295,349 A * 3/1994 Okamoto ..... D01H 4/02 57/328
5,511,373 A * 4/1996 Banba ..... D01H 1/115 57/261
5,647,197 A * 7/1997 Imamura ..... D01H 4/02 57/315
5,673,547 A * 10/1997 Baba ..... D01H 1/115 57/261
5,704,204 A * 1/1998 Mima ..... D01H 15/002 57/261
5,802,831 A * 9/1998 Imamura ..... D01H 15/002 57/261
5,813,209 A * 9/1998 Hirao ..... D01H 15/002 57/22
5,934,058 A * 8/1999 Hirao ..... D01H 15/002 57/261
6,209,304 B1 * 4/2001 Feuerlohn ..... D01H 1/115 19/228
6,453,656 B1 * 9/2002 Nakayama ..... D01H 1/115 57/261
6,543,580 B1 4/2003 Gathmann et al.
6,705,072 B2 * 3/2004 Anderegg ..... D01H 4/02 57/315
6,782,685 B2 * 8/2004 Bischofberger ..... D01H 1/115 57/328
6,959,532 B2 * 11/2005 Wust ..... D01H 1/115 57/22
7,328,569 B2 * 2/2008 Schweier ..... D01H 1/115 57/350
7,464,529 B2 * 12/2008 Stahlecker ..... D01H 1/115 57/263
7,464,530 B2 * 12/2008 Stahlecker ..... D01H 1/115 57/263
9,290,863 B2 * 3/2016 Gotz ..... D01H 1/115
9,370,896 B2 * 6/2016 Mark ..... D01H 1/115
2002/0124543 A1 * 9/2002 Bischofberger ..... D01H 1/115 57/5
2004/0025488 A1 * 2/2004 Anderegg ..... D01H 1/115 57/400
2005/0188672 A1 9/2005 Simmonds
2007/0125062 A1 * 6/2007 Schaeffler ..... D01H 1/115 57/401
2008/0072562 A1 * 3/2008 Wust ..... D01H 1/115 57/333
2008/0190089 A1 * 8/2008 Stahlecker ..... D01H 1/115 57/350
2011/0173945 A1 * 7/2011 Schweier ..... D01H 4/02 57/333
2012/0192541 A1 * 8/2012 Artzt ..... D01H 4/02 57/350
2014/0208711 A1 * 7/2014 Griesshammer ..... D01H 1/115 57/333
2015/0240393 A1 * 8/2015 Haska ..... D01H 1/115 57/333
2015/0283746 A1 * 10/2015 Schaffler ..... B29C 47/0014 425/319
2015/0283747 A1 * 10/2015 Hofmann ..... B29C 47/0014 425/319
2015/0284878 A1 * 10/2015 Kubler ..... D01D 5/06 425/461
2015/0329994 A1 * 11/2015 Schaffler ..... D01H 4/08 57/410

FOREIGN PATENT DOCUMENTS

DE 102012101039 A1 8/2013
EP 1039011 A2 9/2000
JP H1143829 A 2/1999
WO WO2013117493 A1 8/2013

* cited by examiner

SPINNING UNIT OF AN AIR JET SPINNING MACHINE AND THE OPERATION OF SUCH A MACHINE

FIELD OF THE INVENTION

The present invention relates to a method for operating an air jet spinning machine, whereas the air jet spinning machine features at least one spinning unit with one spinning nozzle for producing a yarn, whereas, during the normal operation of the spinning unit, a fiber composite is fed to the spinning nozzle through an inlet and in a predefined transport direction. The fiber composite within a vortex chamber of the spinning nozzle receives a twist with the assistance of a vortex air flow, such that a yarn is formed from the fiber composite, which ultimately leaves the spinning nozzle through an outlet, and is spooled on a sleeve with the assistance of a spooling device. After an interruption in yarn production, a piecing process is carried out, with which one yarn end on the spool side moves counter to the transport direction through the spinning nozzle, is overlaid with one end of the fiber composite after passing through the spinning nozzle and, together with this, is brought through the inlet into the spinning nozzle. After the conclusion of the specified steps of the piecing process, the production of yarn is continued through the resumption of normal operation.

Furthermore, an air jet spinning machine is proposed, which features at least one spinning unit with one spinning nozzle for producing a yarn from the fiber composite fed to the spinning nozzle. The spinning nozzle features one inlet for the fiber composite, one internal vortex chamber, one yarn formation element protruding into the vortex chamber along with one outlet for the yarn produced inside the vortex chamber with the assistance of a vortex air flow.

BACKGROUND OF THE INVENTION

Air jet spinning machines conforming to this type serve the purpose of the production of a yarn from an elongated fiber composite with the assistance of a vortex air flow generated by corresponding air nozzles within the vortex chamber. Thereby, in the area of the inlet mouth of the typically spindle-shaped yarn formation element, the outer fibers of the fiber composite are wound around the internal fibers (core), such that, as a result, a stable yarn arises, which can be ultimately led away through the draw-off channel from the vortex chamber and, with the assistance of the specified spooling device, can be spooled on a sleeve.

During the spinning process, if spinning flaws arise (thick or thin parts of the yarn, yarn tears, unsatisfactory feed of the fiber composite, etc.), or if the spinning machine is stopped for a certain period of time, a piecing process is necessary subsequent to the respective event that interrupts the production of yarn. In this case, the end on the spool side of the already produced yarn (that is, the end section of the yarn section last spooled prior to the interruption of yarn production) is fed back, counter to the actual spinning direction (which corresponds to the transport direction specified above), through the draw-off channel into the vortex chamber, and from there into the area of the inlet (or a fiber guide element placed in this area). Following the return, outside of the spinning nozzle, with the assistance of a service robot, a device on the spinning unit or manual effort, the yarn is brought into contact with the end of the fiber composite through an overlap on both sides.

Finally, the yarn end, and with it the end of the fiber composite, is moved inside the vortex chamber by switching on the air nozzles and starting the spooling device and is exposed there to the vortex air flow (whereas, at this point in time, the device delivering the fiber composite, which is preferably formed by a drafting system upstream of the spinning nozzle in the transport direction, is or was already in operation, in order to convey the fiber composite in the direction of the inlet of the spinning nozzle). The connection area or overlap area between the yarn end and the end of the fiber composite ultimately passes through the inlet mouth of the spindle. The spinning process then continues as usual; that is, the spinning unit once again operates in normal mode and produces a yarn.

While the piecing process described above has become accepted and has delivered satisfactory results in this regard, it cannot be ruled out that the connection of yarn end and the corresponding end of the fiber composite fails during the piecing process or comes loose again prior to passing through the spinning nozzle. In such an event, the piecing process must be carried out once again, possibly after a corresponding cleaning of the spinning nozzle, such that the method appears worthy of improvement with regard to its reliability.

SUMMARY OF THE INVENTION

Therefore, a task of the present invention is to improve the piecing process in respect of the state of the art, and to propose an air jet spinning machine to carry out such a piecing process. Additional objects and advantages of the invention will be set forth in part in the following description, or may be obvious from the description, or may be learned through practice of the invention.

The task is solved by a method and an air jet spinning machine as described and claimed herein.

In accordance with the invention, the method is characterized by the fact that, during the piecing process, at least temporarily, additive is applied at the end of the fiber composite (with which the yarn end is overlapped, or has already been brought into contact with it). In contrast to the state of the art, the end of the fiber composite, which, during the piecing process, is overlapped with the specified yarn end and together with this is introduced in or sucked into the spinning nozzle, is wetted with an additive. The additive may comprise water or an aqueous solution that may include one or more additional substances. For example, surfactants (acid and alkaline solutions as well as bleaching agents) or protic or aprotic solvents are conceivable. Furthermore, solid additives or corresponding suspensions can be used in addition to liquid additives. In any event, the addition of the additive during the piecing process (that is, between the commencement of the return of the yarn end and the return to normal operation) brings about the stabilization and strengthening of the overlap area between the yarn end and the end of the fiber composite, such that a very stable connection area between the specified sections arises. Thereby, the coming loose of the connection area during the piecing process or subsequent normal operation and the subsequent further processing of the yarn is nearly ruled out. Likewise, the structure of the connection area is positively influenced by the application of the additive, such that the connection area in the finished yarn is nearly no longer detectable. The additive may be sprayed, for example, at the end of the fiber composite. The additive reservoir may be designed depending on the choice of the additive, and may be formed, for example, by a tank, a distribution system or filled cartridges allocated to the spinning unit. In addition, one or more additive supply lines are provided, through which the additive reservoir is connected to an additive delivery, whereas the latter may be formed, for example, by a hollow needle, a spray head or an additive outlet opening of a channel section. Finally, the application of the additive is to take place in a stage of the piecing process in which the end of the fiber composite is already moving in the direction of the spinning nozzle, in order to provide the fiber composite with additive evenly.

In particular, it is advantageous if the additive is applied at the end of the fiber composite after it has been overlaid with the yarn end. It is particularly advantageous if the addition of additive starts soon or shortly after the fiber composite is delivered in the direction of the inlet of the spinning nozzle with the assistance of (for example) the specified drafting system. The connection area between the yarn end and the end of the fiber composite is thereby strengthened, before it arrives in the area of vortex air flow within the vortex chamber. Alternatively, it would finally be conceivable to apply the additive at the end of the fiber composite before it is overlaid with the yarn end.

It is particularly advantageous if the additive is applied in the area of the inlet or, viewed in the transport direction, in front of the inlet of the spinning nozzle at the end of the fiber composite. For example, it is advantageous if the additive takes place in the area between the inlet of the spinning nozzle and a device delivering the fiber composite, for example, a drafting system upstream of the spinning nozzle. In this case, the end of the fiber composite provided with additive does not arrive into contact with the device delivering the fiber composite, such that possible complications associated with this are avoided. In particular, the additive should therefore be applied in the immediate area in front of the inlet of the spinning nozzle at the end of the fiber composite. Ultimately, furnishing the additive in the area of a fiber guide element forming the inlet of the spinning nozzle at the connection area between the yarn end and the end of the fiber composite is also conceivable. In this case, the fiber guide element may feature an additive outlet opening arranged inside of the same, which leads to a passage channel, through which the connection area and the subsequently delivered fiber composite arrives in the vortex chamber of the spinning nozzle.

It is particularly advantageous if the volume flow of the fed additive features, during the piecing process, at least temporarily, an amount between 0.001 ml and 2.0 ml/min, preferably between 0.01 ml and 1.0 ml/min, and/or if the mass flow of the fed additive features, during the piecing process, at least temporarily, between 0.001 g/min and 2.0 g/min, preferably between 0.01 g/min and 1.0 g/min. While a higher volume flow or mass flow could bring about the sticking together of the areas of the spinning unit coming into contact with the connection area, the specified area ensures a reliable connection of the yarn end and the end of the fiber composite.

It is advantageous if, during the addition of additive, the volume flow or mass flow of the additive is regulated with the assistance of at least one valve, whereas, in the operation of the same, the valve is opened and closed at least once per second, such that the additive fed to the valve passes through the valve in a pulse-like manner. Thus, in contrast to conventional valves, additive does not continuously flow through such a valve. Rather, it is provided that the additive stream is composed of a multitude of the smallest droplets or additive units (if a gas or a solid, and not a liquid, is used), which are produced through rapid opening and closing and leave the valve. In doing so, if the valve is opened and closed once or several times per second, an additive stream is produced, which corresponds to a continuous additive stream in its result, even if it actually consists of a multitude of individual droplets that leave the valve closely behind one another. Given that the volume or mass of a droplet or a unit is extremely low, and that the switching frequency of the valve (that is, the number of opening and closing operations per second) is adjustable with a high degree of precision, the quantity of the additive applied to the fiber composite is also highly precise and reproducibly adjustable. An additional advantage lies in the fact that if the valve remains in its closed position, it immediately closes completely. If a liquid additive is used, any dripping caused by a low volume of individual droplets is ruled out.

It is particularly advantageous if, during the piecing process, the volume flow or mass flow of the fed additive is, at least temporarily, higher than that during the normal operation of the spinning unit following the piecing process. Thus, for example, it would be conceivable to select the volume flow or mass flow during the piecing process according to the above description, while, in the subsequent normal operation, this features a maximum of 1.0 ml/min (or g/min), preferably 0.5 ml/min (or g/min). The exact value may be selected depending on the characteristics of the fiber composite and/or its feeding speed into the spinning unit and/or the draw-off speed of the yarn from the spinning unit, and thus may vary depending on the application.

It is particularly advantageous if, during the piecing process, the volume flow or mass flow of the fed additive is, at least temporarily, reduced compared to an initial amount, whereas the reduction particularly takes place at the end of the piecing process. Thereby, it is possible to, during the piecing process, gradually reduce the quantity of the fed additive to the quantity that is desired during the subsequent normal operation of the spinning unit.

It is also advantageous if the reduction of the volume flow or mass flow of the fed additive takes place continuously. Here the reduction may take place abruptly, in stages or even gradually (that is, uniformly), whereas, for example, a linear decrease in the quantity of additive delivered at the end of the fiber composite is conceivable. In addition, the quantity of the fed additive should be reduced no later to the quantity provided for normal operation, if the connection area between the yarn end and the end of the fiber composite has passed through the additive outlet opening of the additive supply, such that the subsequent fiber composite is already provided with a quantity of additive that is lower than that of the specified connection area.

The air jet spinning machine in accordance with the invention is characterized by the fact that an additive supply is allocated to at least one spinning unit of the air jet spinning machine (of course, multiple spinning units can also be present), with the assistance of which an additive can be applied at an end of the fiber composite present after an interruption in the yarn production. In addition, the additive supply, which is to comprise at least one additive reservoir and one additive outlet opening connected with this in the area of the spinning nozzle, is in operative connection with a control unit, which is configured to, after an interruption in yarn production, initiate a piecing process in accordance with the description set forth above or below, during which, at least temporarily, additive is applied at the end of the fiber composite. The application of the additive may take place according to individual or all of the aspects set forth above or below, whereas the spinning unit may feature in particular the correspondingly described physical characteristics.

BRIEF DESCRIPTION OF THE DRAWINGS

Additional advantages of the invention are described in the following embodiments. This following is shown, in each case schematically.

DETAILED DESCRIPTION

Figure 1:
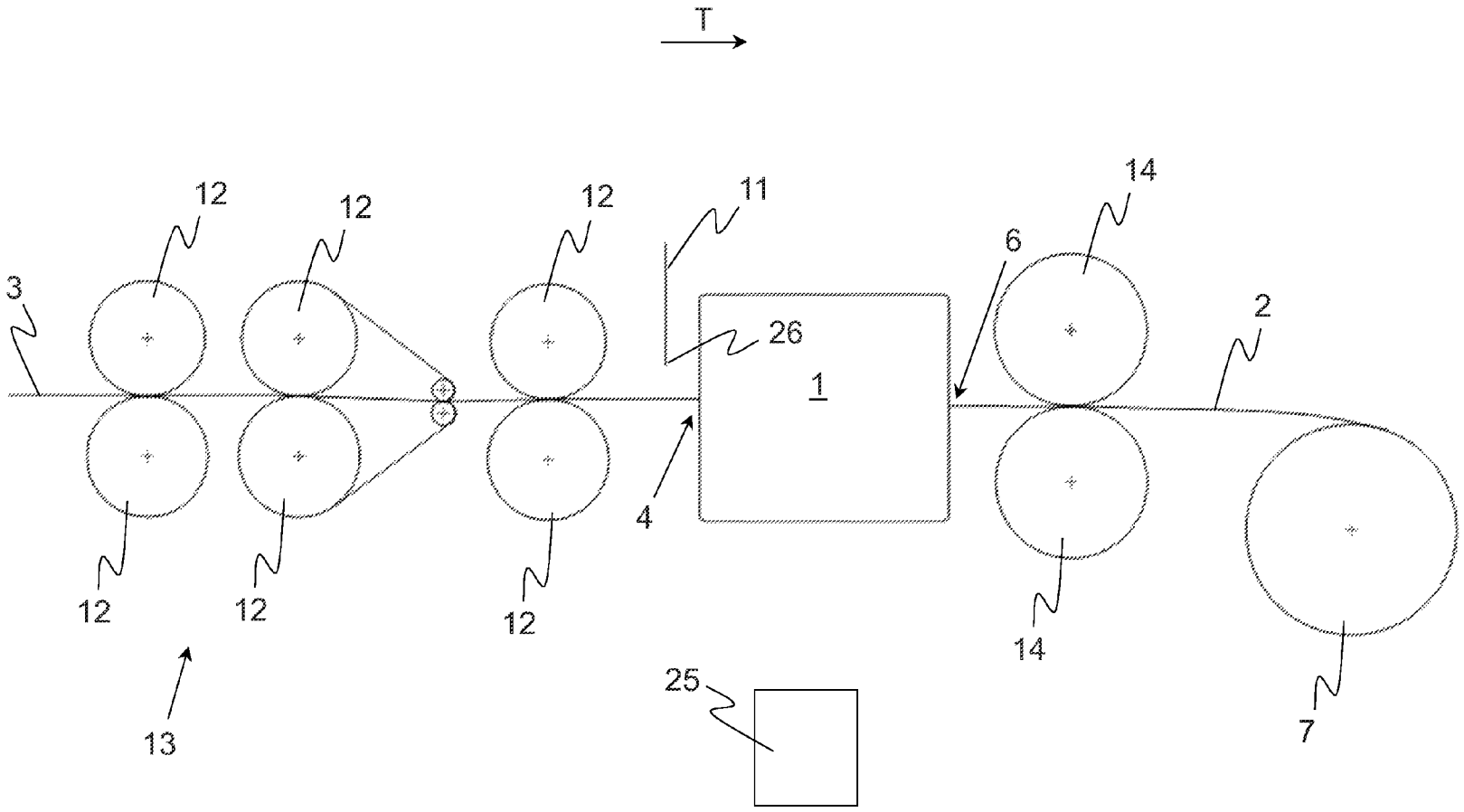
FIG. 1 a schematic view of a spinning unit of an air jet spinning machine in accordance with the invention during the normal operation of the same, FIG. 2 a sectional view of a spinning nozzle of a spinning unit of an air jet spinning machine in accordance with the invention, FIG. 3 the spinning unit in accordance with FIG. 1 after an interruption of yarn production, FIG. 4 the spinning unit in accordance with FIG. 1 after the return of the yarn end counter to the transport direction, and FIG. 5 the spinning unit in accordance with FIG. 1 during a piecing process with the application of additive at the end of the fiber composite.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
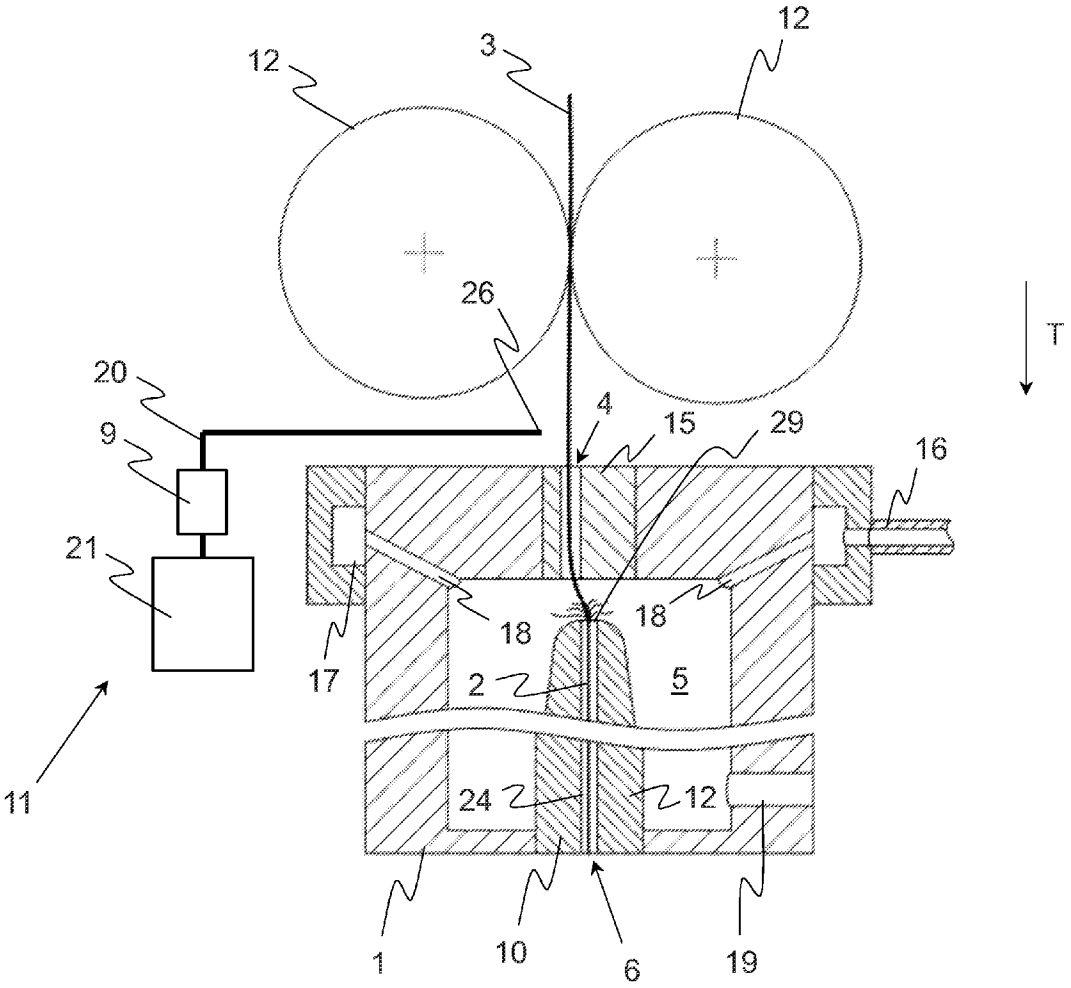

FIG. 1 shows a cut-out of a spinning unit of an air jet spinning machine in accordance with the invention (whereas the air jet spinning machine may, of course, feature a multitude of spinning units, preferably arranged in a manner adjacent to each other). When required, the air jet spinning machine may include a drafting system 13 with several drafting system rollers 12, which is supplied with a fiber composite 3 in the form of, for example, a doubled sliver. Furthermore, the spinning unit that is shown includes a spinning nozzle 1 with an internal vortex chamber 5, which is shown in more detail in FIG. 2, in which the fiber composite 3 or at least a part of the fibers of the fiber composite 3 is, after passing through an inlet 4 of the spinning nozzle 1, provided with a twist (the exact mode of action of the spinning unit is described in more detail below).

Moreover, the air jet spinning machine may include a pair of draw-off rollers 14 downstream of the spinning nozzle 1 that features two draw-off rollers 14 along with a spooling device 7 downstream of the pair of draw-off rollers for the spooling of the yarn 2 leaving the spinning unit onto a sleeve. The spinning unit in accordance with the invention need not necessarily feature a drafting system 13. The pair of draw-off rollers is also not absolutely necessary, or may be replaced with an alternative draw-off unit.

Generally, the spinning unit that is shown works according to an air spinning process. For the formation of the yarn 2, the fiber composite 3 is led in a transport direction T through a fiber guide element 15, which is provided with an inlet opening forming the specified inlet 4, into the vortex chamber 5 of the spinning nozzle 1. At that point, it receives a twist; that is, at least one part of the free fiber ends of the fiber composite 3 are captured by a vortex air flow that is generated by air nozzles 18 correspondingly arranged in a vortex chamber wall 5 surrounding the vortex chamber 5, whereas the air nozzles 18 are fed with compressed air through an air distributor 17 (which, for example, is ring-shaped and is connected to an air supply line 16). Thereby, a part of the fibers is pulled out of the fiber composite 3 at least to some extent, and wound around the top of the yarn formation element 10 protruding into the vortex chamber 5. Given that the fiber composite 3 is extracted through an inlet mouth 29 of the yarn formation element 10 through a draw-off channel 22 arranged within the yarn formation element 10, out of the vortex chamber 5, and finally through an outlet 6 out of the spinning nozzle 1, the free fiber ends are also ultimately drawn in the direction of the inlet mouth 29 and thereby, as so-called "winding fibers", loop around the core fiber running in the center—resulting in a yarn 2 featuring the desired twist. The compressed air introduced through the air nozzles 18 leaves the spinning nozzle 1 ultimately through the draw-off channel 22 along with an air outlet 19 that might be present, which, when required, may be connected to a vacuum power source.

With regard to the air nozzles 18, it must also be mentioned at this point, purely as a matter of precaution, that they typically should be generally aligned in such a manner that the escaping air streams are unidirectional, in order to generate a unidirectional air flow with a rotational direction. Preferably, the individual air nozzles 18 are in this case arranged in a manner that is rotationally symmetric to each other, and tangentially flow into the vortex chamber 5.

Figure 3:
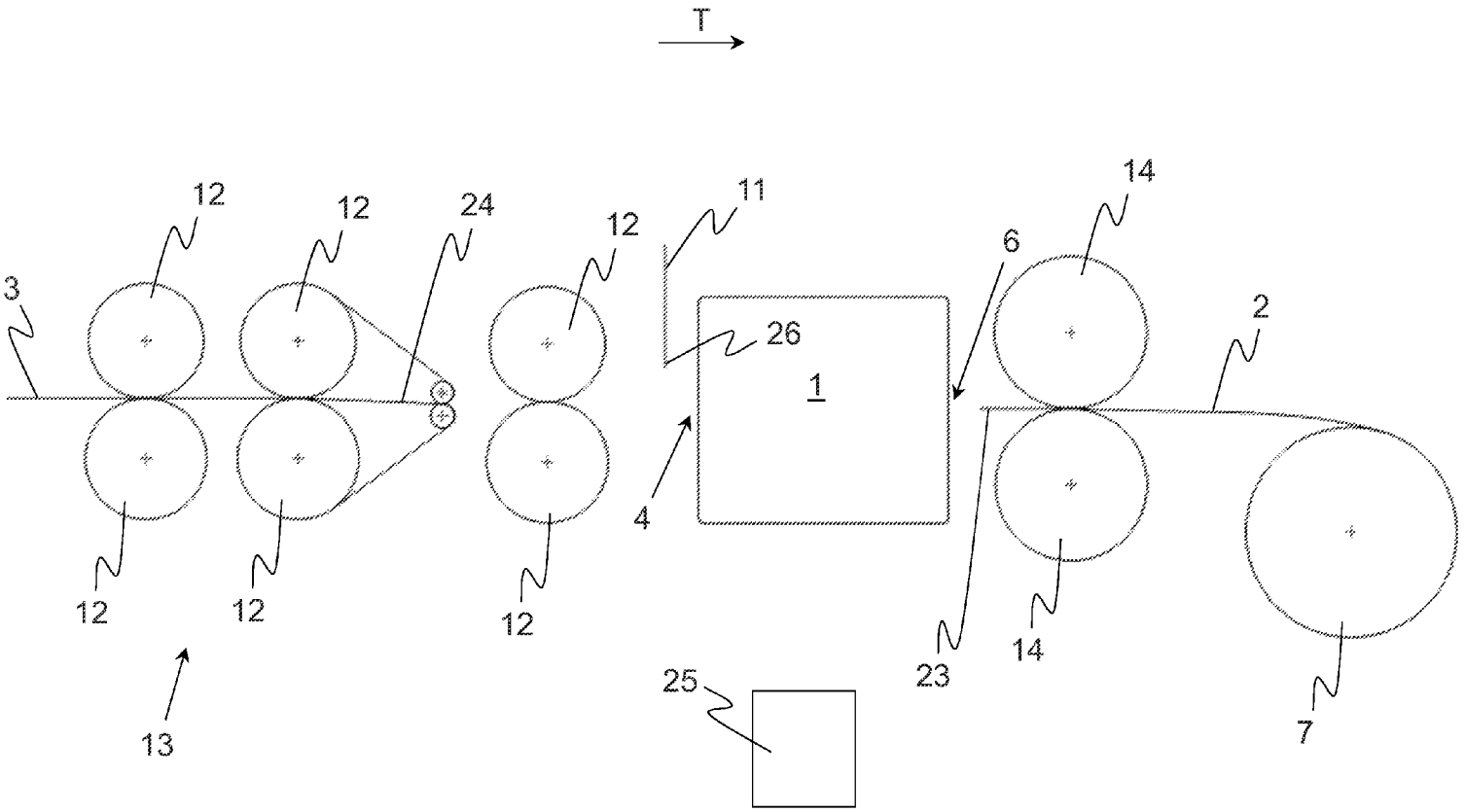

During yarn production, it cannot be ruled out that, for various reasons, thick or thin parts in the yarn 2 arise. In this case, yarn production is interrupted by the control unit 25, such that a yarn end 23 on the spool side arises. After the interruption of yarn production, the yarn end 23 may be located on the surface of the spool found on the spooling device 7 or in the area between the spooling device 7 and the spinning nozzle 1, preferably between the outlet 6 of the same and the draw-off rollers 14 (see FIG. 3). During yarn production, unwanted yarn breakages may also arise, which likewise have the consequence of a corresponding yarn end 23 along with an end 24 of the fiber composite 3 coming to a stop in the area of the correspondingly stopped drafting system 13.

Figure 4:
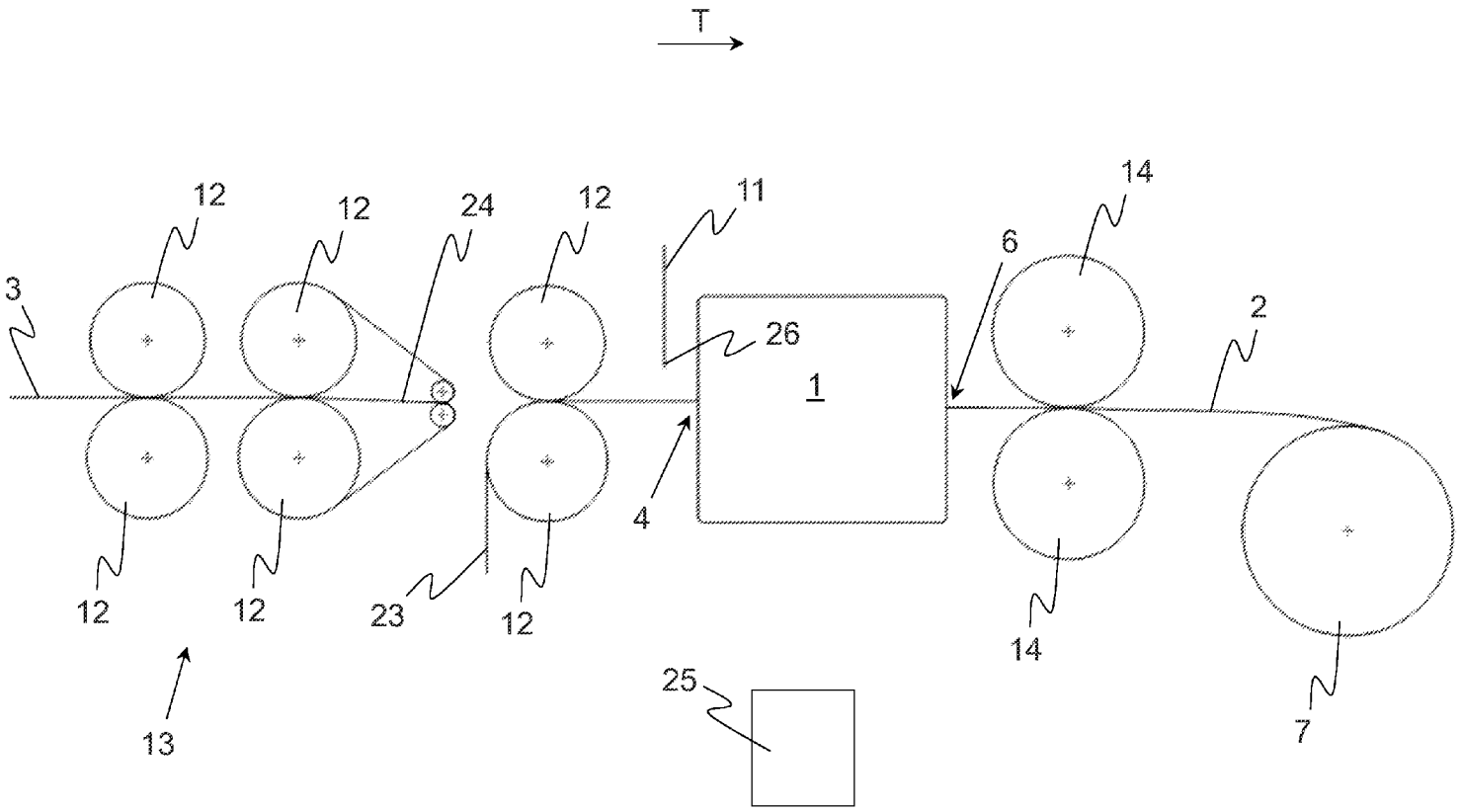
Figure 5:
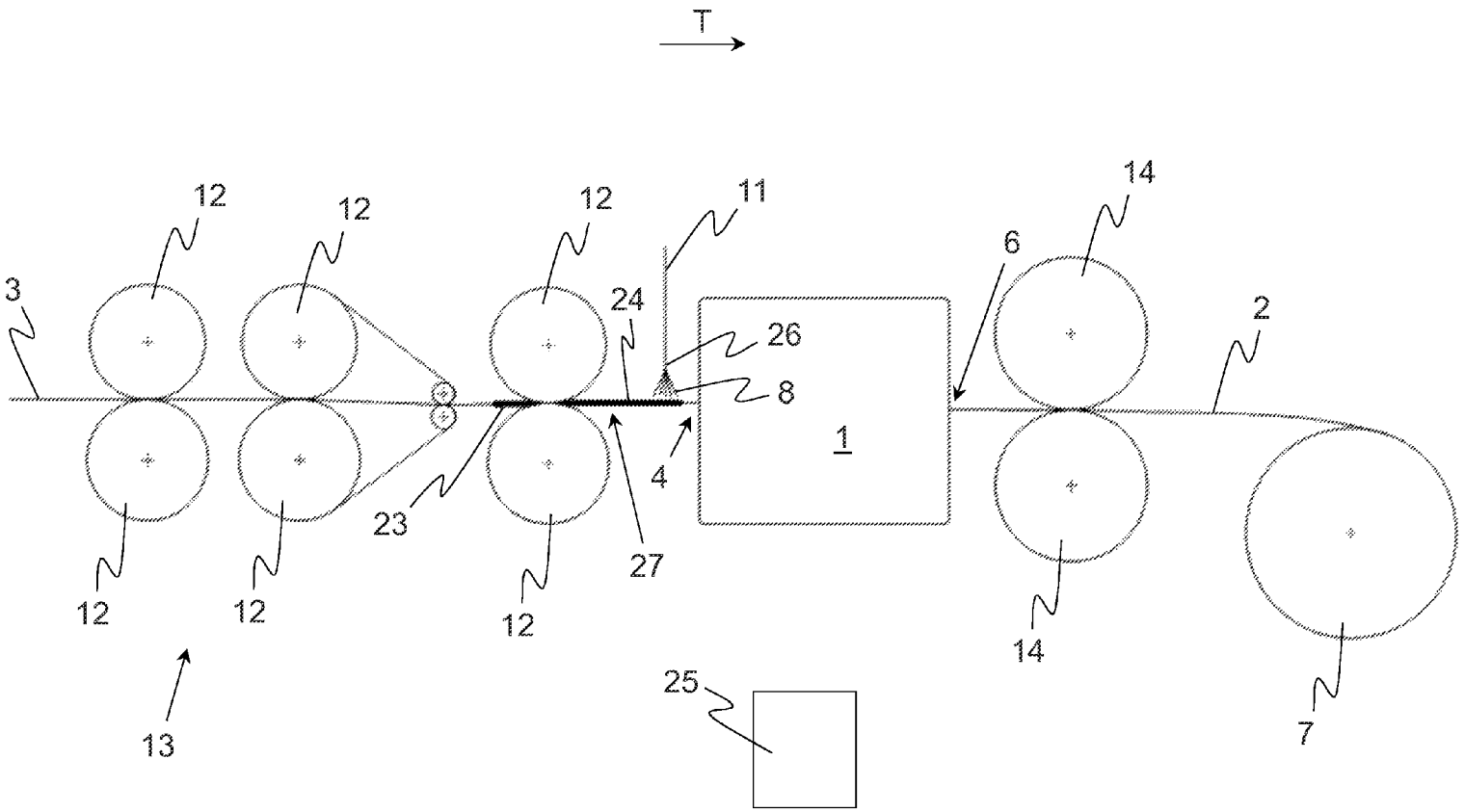

In order to resume yarn production (that is, the normal operation of the respective spinning unit), the specified yarn end 23 must be connected to the end 24 of the fiber composite 3. For this purpose, it is provided that the yarn end 23 is fed counter to the transport direction T through the spinning nozzle 1, whereas, for this purpose, the spool found in the spooling device 7 is driven backwards in order to release a corresponding quantity of yarn. The yarn end 23 or a yarn end 23 newly arising through the removal of the yarn section featuring the yarn flaw is, at this stage, conveyed with the assistance of mechanical or pneumatic means in the area of the outlet 6 of the spinning nozzle 1, and is sucked into this with the assistance of a negative pressure prevailing in the draw-off channel 22. With the assistance of a corresponding air flow, the further conveying of the yarn end 23 ultimately takes place through the inlet 4 of the spinning nozzle 1, until it is located in the area in front of the spinning nozzle 1 (viewed in the transport direction T). In particular, it is advantageous here if the yarn end 23 is moved until it is located between the two drafting system rollers 12 of the drafting system 13 on the outlet side (for this purpose, the specified stretching unit rollers 12 are moved away from each other prior to the passing of the yarn end 23, in order to enable the specified passing; after passing the yarn end 23, they are finally brought back into the position shown in FIG. 4, in which the yarn end 23 is fixed in a clamping manner).

In the next step, the drafting system rollers 12, the draw-off rollers 14 and the spooling device 7 on the outlet side and fixing the yarn end 23 are put back into operation, such that the yarn end 23 moves in the transport direction T. At the same time or temporarily postponed, the remaining drafting system rollers 12 are also put back into motion, whereas the beginning of their rotation along with the corresponding rotational speed are adjusted in such a manner that the end 24 of the fiber composite 3 arrives in overlapping contact with the yarn end 23 and, together with it, can be drawn into the spinning nozzle 1.

In order to strengthen the connection area 27 (that is, the overlap area between the yarn end 23 and the end 24 of the fiber composite 3) or to improve the fiber orientation in this area compared to the state of the art, in accordance with the invention, it is proposed that an additive 8 is delivered at the end 24 of the fiber composite 3.

For this purpose, the spinning unit features an additive supply 11, which preferably includes one or more additive reservoirs 21 that supply an additive 8 (for example, in the form of pressure tanks) along with one or more additive supply lines 20 (which are preferably at least partially flexible), through which the respective additive reservoir 21 is in fluid connection with an additive outlet opening 26 arranged in the area of the spinning nozzle 1 (with regard to a possible additive 8, reference is made to the previous description). Preferably, the additive outlet opening 26 is arranged in the area of the inlet 4 of the spinning nozzle 1 or the specified fiber guide element 15. In particular, the delivery should take place at a location that is passed by the connection area 27 ("yarn end 23-end 24 of the fiber composite 3"), in order to strengthen or stabilize this area through the additive 8. The quantity of the delivered additive 8 may take place with the assistance, for example, of a valve 9 integrated, for example, into the additive supply line 20 (with regard to possible details of valve 9, reference is made to the above description).

The invention is not limited to the illustrated and described embodiments. Variations within the framework of the patent claims, such as any combination of the described characteristics, even if they are illustrated and described in different parts of the description or the claims or in different embodiments.

LIST OF REFERENCE SIGNS

1 Spinning nozzle
2 Yarn
3 Fiber composite
4 Inlet of the spinning nozzle
5 Vortex chamber
6 Outlet of the spinning nozzle
7 Spooling device
8 Additive
9 Valve
10 Yarn formation element
11 Additive supply
12 Drafting system roller
13 Drafting system
14 Draw-off roller
15 Fiber guide element
16 Air supply line
17 Air distributor
18 Air nozzle
19 Air outlet
20 Additive supply line
21 Additive reservoir
22 Draw-off channel
23 Yarn end
24 End of the fiber composite
25 Control unit
26 Additive outlet opening
27 Connection area between the yarn end and the end of the fiber composite
28 Inlet mouth of the yarn formation element
T Transport direction

The invention claimed is:

1. A method for operating an air jet spinning machine, wherein the air jet spinning machine features at least one spinning unit with a spinning nozzle for producing a yarn, the method comprising:

during normal operation of the spinning unit, feeding a fiber composite to the spinning nozzle through an inlet and in a predefined transport direction, wherein the fiber composite within a vortex chamber of the spinning nozzle receives a twist with the assistance of a vortex air flow, such that a yarn is formed from the fiber composite, the yarn leaving the spinning nozzle through an outlet;

spooling the yarn on a sleeve with assistance of a spooling device;

carrying out a piecing process after an interruption in the yarn production wherein a yarn end from a spool side of the spinning nozzle is moved counter to the transport direction through the spinning nozzle, is overlaid with an end of the fiber composite after passing through the spinning nozzle, the overlaid yarn end and fiber composite end brought through the inlet into the spinning nozzle;

during the piecing process, applying an additive to the end of the fiber composite; and after conclusion of the piecing process, resuming production of the yarn in the normal operation.

2. The method according to claim 1, wherein the additive is applied at the end of the fiber composite after it has been overlaid with the yarn end.

3. The method according to claim 2, wherein the additive is applied in front of the inlet of the spinning nozzle viewed in the transport direction.

4. The method according to claim 1, wherein a volume flow of the fed additive during the piecing process is between 0.001 ml/min and 2.0 ml/min, or a mass flow of the fed additive during the piecing process is between 0.001 g/min and 2.0 g/min.

5. The method according to claim 4, wherein during the addition of additive, the volume flow or mass flow of the additive is regulated with assistance of a valve that is opened and closed at least once per second such that the additive fed to the valve passes through the valve in a pulse-like manner.

6. The method according to claim 4, wherein during the piecing process, the volume flow or mass flow of the additive is higher than that during the normal operation of the spinning unit following the piecing process.

7. The method according to claim 4, wherein during the piecing process, the volume flow or mass flow of the additive is reduced compared to an initial amount at start of the piecing operation.

8. The method according to claim 7, wherein the reduction of the volume flow or mass flow of the additive is continuous through the piecing operation.

9. An air jet spinning machine, comprising:

a spinning unit with a spinning nozzle for producing a yarn from a fiber composite fed to the spinning nozzle, the spinning nozzle comprising an inlet for the fiber composite;

an internal vortex chamber defined in the spinning nozzle;

a yarn formation element protruding into the vortex chamber;

an outlet for the yarn produced in the vortex chamber with assistance of a vortex air flow generated in the vortex chamber;

an additive supply allocated to the spinning unit and configured to apply an additive at an end of the fiber composite present after an interruption in the yarn production;

a control unit in operative connection with the additive supply and configured to, after an interruption in yarn production, initiate a piecing process wherein additive is applied at the end of the fiber composite.

10. The air jet spinning machine according to claim 9, wherein the additive supply further comprises a feed valve, the control unit in operative connection with the feed valve to regulate a volume flow of the additive during the piecing process is between 0.001 ml/min and 2.0 ml/min, or a mass flow of the additive during the piecing process is between 0.001 g/min and 2.0 g/min, wherein the valve is further opened and closed at least once per second such that the additive fed to the valve passes through the valve in a pulse-like manner.

* * * * *